US005449008A

United States Patent [19]

Yeh

[11] Patent Number: 5,449,008

[45] Date of Patent: Sep. 12, 1995

[54] FOLDABLE HAIR CLASP

[76] Inventor: Chia-Ching Yeh, No. 9, Alley 3, Lane 76, Sec. 6, Hsin-I Rd., Taipei,

[21] Appl. No.: 177,213

[22] Filed: Jan. 4, 1994

[51] Int. Cl.[6] ..... A45D 8/36

[52] U.S. Cl. ..... 132/273; 132/275

[58] Field of Search ..... 132/273, 275; 2/171, 2/181, 209, DIG. 11

[56] References Cited

U.S. PATENT DOCUMENTS

| | | | |
|---|---|---|---|
| 3,211,160 | 10/1965 | Miller | 132/275 |
| 3,858,590 | 1/1975 | Lowery | 132/275 |
| 4,404,434 | 9/1983 | Pelt | 2/209 |
| 4,671,265 | 6/1987 | Andersson | 2/209 |

FOREIGN PATENT DOCUMENTS

| | | | |
|---|---|---|---|
| 624247 | 7/1927 | France | 132/273 |
| 630965 | 1/1930 | France | 132/273 |

*Primary Examiner*—John G. Weiss

*Assistant Examiner*—Elise P. Speaks

*Attorney, Agent, or Firm*—W. Wayne Liauh

[57] ABSTRACT

A foldable hair clasp containing a mid section and two end sections, the end sections are removably and respectively connected to two ends of the mid section. A pair of hinge members are provided for connecting between the mid section and each of the end sections, respectively. Each of the hinge members comprises a hinge with two hinge plates. A pair of protrusions are provided on the mid section and each of the end sections, respectively. The protrusion has a sloping height tapered from the outer edge of the mid or end section and finally leveled with the inner surface of the mid or end section. The protrusion is also provided with an inner slot for receiving one of the hinge plates so as to allow the end sections to be folded inwardly and rest against the inside of the mid section to therefore reduce the size of the hair clasp.

3 Claims, 4 Drawing Sheets

FOLDABLE HAIR CLASP

BACKGROUND OF THE INVENTION

A hair clasp is usually used by a female for holding her hair in a style desired; since the hair clasp is easy to use, and cheap in price, it has been used widely by female consumers. The hair clasp is usually a rigid ring-shaped structure, it takes a considerable space when not in use, and therefore a user would find it more or less inconvenient to keep in a bag or a pocket.

SUMMARY OF THE INVENTION

This invention relates to a foldable hair clasp, which comprises a mid section and two end sections; the feature of the present invention is that the hair clasp may have three or more than three sections; a hinge is mounted between every two sections for folding the same into a smaller size so as to be put in a small space when not in use.

DETAILED DESCRIPTION

Figure 1:
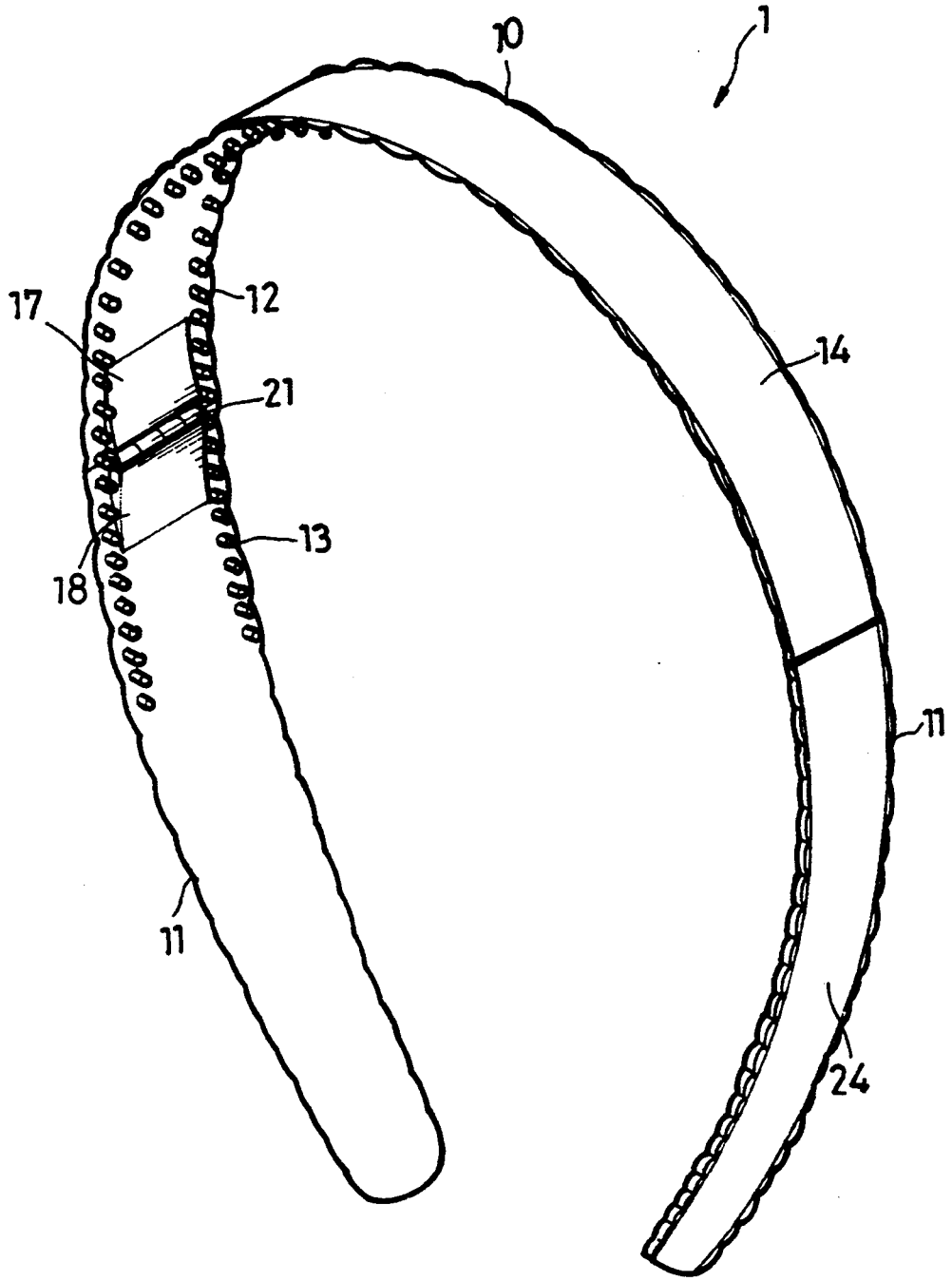
FIG. 1 is a perspective view of an embodiment according to the present invention.
Figure 2:
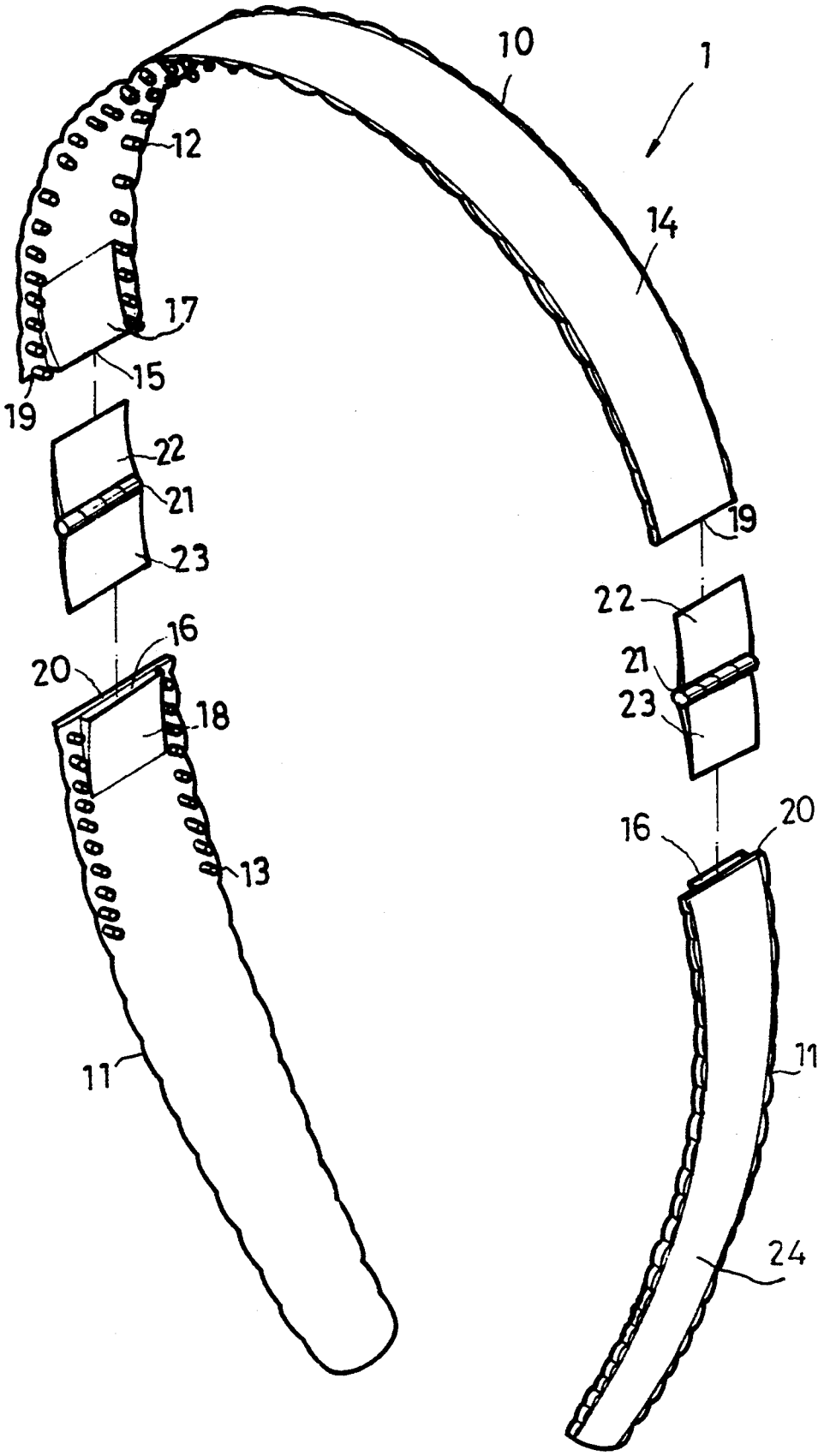
FIG. 2 is a disassembled view of the present invention.

Referring to FIGS. 1 and 2, the present invention is shown with a perspective view and a disassembled view of a hair clasp 1, which comprises a mid section 10 and two symmetrical end sections 11, i.e., having three sections (likewise, it may be designed into two or more than two sections). The mid section 10 and the end sections 11 each are a curved plate, and the three sections are formed into a hoop. Each of the end sections 11 is shorter than the mid section 10 so as to facilitate its folding. The inner side of the mid section 10 and the end sections is similar to the conventional hair clasp, being provided with a plurality of beads 12 and 13 so as to have a better gripping force. The outer side of the hair clasp is to be decorated with various patterns or the like, being referred to as decoration sides 14 and 24. The inner sides of both ends of the mid section 10 and the ends of the two end sections 11 are provided with inserting slots 15 and 16 respectively, of which the outer walls 17 and 18 are formed into a sloping shape respectively; the sloping height is reduced gradually from the contact surface. The highest point of the sloping shape is not higher than that of the beads 12 and 13. Both ends of the mid section 10 have flat contact surfaces 19 respectively. The upper ends of the two end sections 11 also have flat contact surfaces 20 respectively. The mid section 10 and the two end sections 11 are connected together with two hinges 21. The two hinge plates 22 and 23 of the hinge 21 are inserted into the inserting slots 15 and 16 in the mid section 10 and the end sections 11 respectively so as to connect the three sections together as one hair clasp. Instead of the inserting method, the hinge 21 can be fastened to the mid section 10 and the two end sections 11 by means of rivets or glue on condition that the beauty of the hair clasp and safety are not affected. Moreover, the hinge connection method may also be replaced with other methods.

Figure 3:
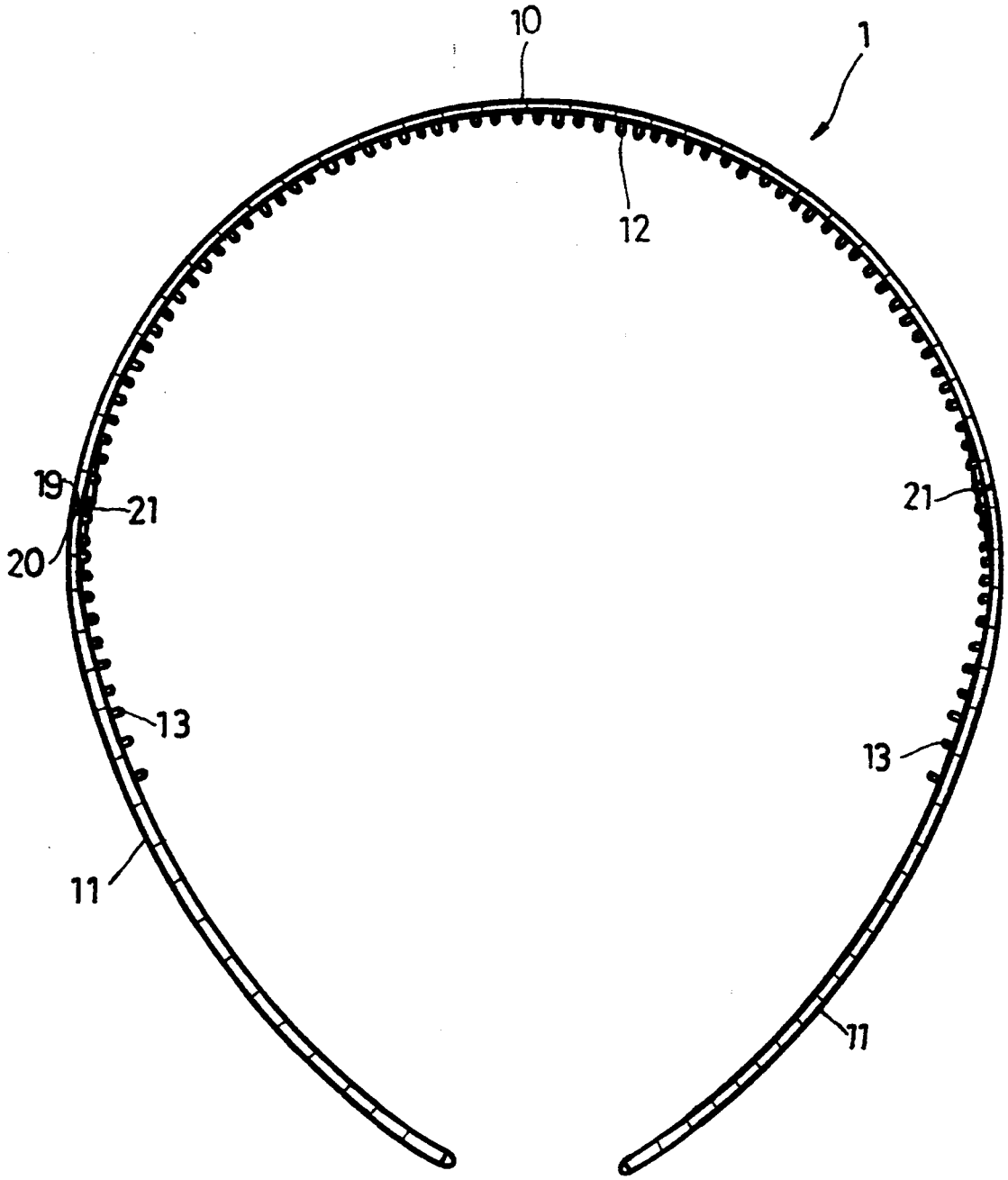
FIG. 3 is a side view of the present invention.
Figure 4:
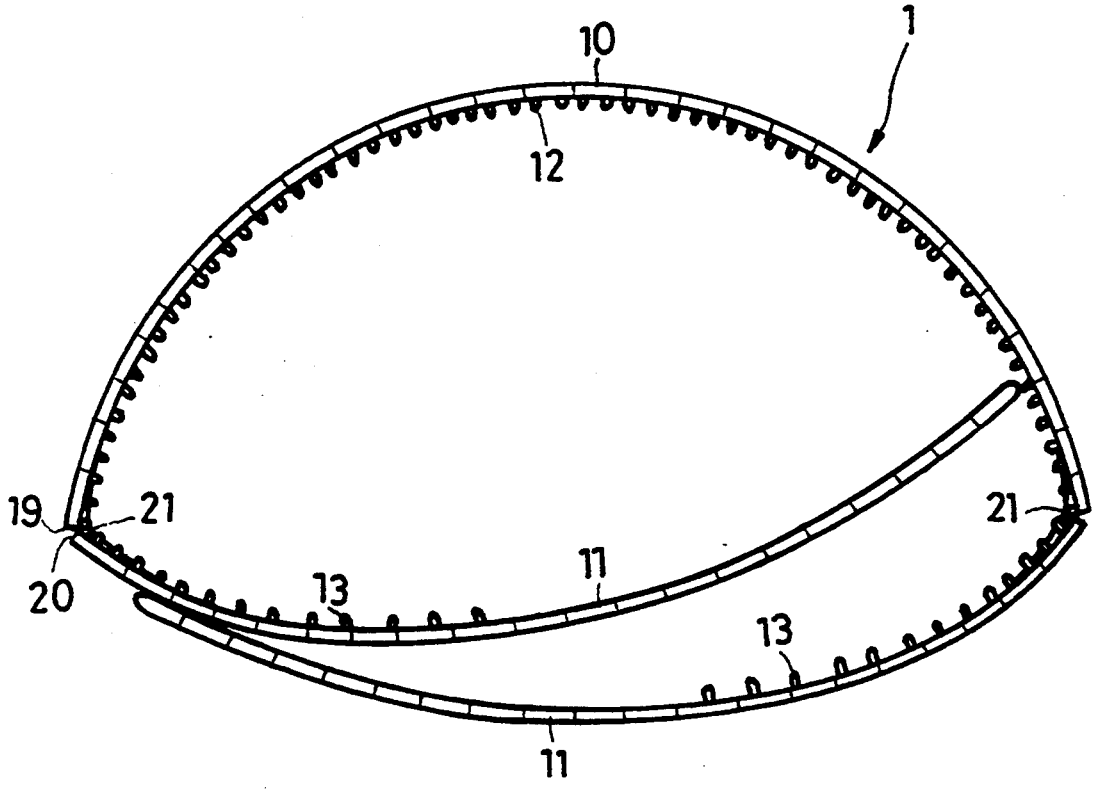
FIG. 4 is a side view of the present invention upon being folded.

FIG. 3 is a side view of the present invention, of which the mid section 10 and the end sections 11 are connected together by means of hinges to form into a hair clasp 1. When the hair clasp is unfolded, it is similar to a hoop because of the contact surfaces 19 and 20 providing a limit function. When not in use, the two end sections 11 can be folded inwards to rest against the inside of the mid section 10 (as shown in FIG. 4) so as to reduce the size thereof and to facilitate keeping it in a bag or a pocket for carrying.

I claim:

1. A foldable hair clasp comprising a mid section and two end sections, said end sections being removably and respectively connected to two ends of said mid section; hinge means for connecting between said mid section and each of said end sections;

wherein each of said hinge means comprising a hinge with two hinge plates and a pair of protrusions respectively formed on said mid section and each of said end sections, said protrusion having a sloping height and an inner slot for receiving one of said hinge plates so as to allow said end sections to be foldably and removably attached to said mid section.

2. A foldable hair clasp as claimed in claim 1, wherein inner sides of said mid section and said end sections each are provided with a plurality of beads.

3. A foldable hair clasp as claimed in claim 1, wherein outer sides of said mid section and said end sections each are provided with a decoration side for patterns or designs.

* * * * *